US009167670B2

(12) United States Patent
Hung et al.

(10) Patent No.: US 9,167,670 B2
(45) Date of Patent: Oct. 20, 2015

(54) METHOD FOR CONTROLLING LAMPS AND COMPUTER PROGRAM PRODUCT THEREOF

(71) Applicant: GUNITECH CORP, Hsinchu County (TW)

(72) Inventors: Chien-Ju Hung, Hsinchu County (TW); Po-Kuei Chou, Hsinchu County (TW); Enoch Zhao, Hsinchu County (TW); Huan-Ruei Shiu, Hsinchu County (TW)

(73) Assignee: Gunitech Corp., Hsinchu County (TW)

( * ) Notice: Subject to any disclaimer, the term of this patent is extended or adjusted under 35 U.S.C. 154(b) by 0 days.

(21) Appl. No.: 13/891,304

(22) Filed: May 10, 2013

(65) Prior Publication Data

US 2014/0252983 A1 Sep. 11, 2014

(30) Foreign Application Priority Data

Mar. 11, 2013 (TW) ..... 102108470 A

(51) Int. Cl.
*H05B 37/02* (2006.01)

(52) U.S. Cl.
CPC ..... *H05B 37/0272* (2013.01); *H05B 37/029* (2013.01)

(58) Field of Classification Search
USPC ..... 315/291, 292, 307, 312, 316, 317, 318; 362/227, 231
See application file for complete search history.

(56) References Cited

U.S. PATENT DOCUMENTS

| | | | | |
|---|---|---|---|---|
| 8,331,908 | B2 | 12/2012 | Verthein et al. | |
| 8,373,366 | B2 | 2/2013 | Baaijens et al. | |
| 8,755,913 | B2 | 6/2014 | McCormack | |
| 2004/0232856 | A1* | 11/2004 | Huber | 315/291 |
| 2005/0248299 | A1 | 11/2005 | Chemel et al. | |
| 2006/0193125 | A1* | 8/2006 | Fluss | 362/145 |
| 2009/0239587 | A1 | 9/2009 | Negron et al. | |
| 2011/0276151 | A1 | 11/2011 | Feri et al. | |

FOREIGN PATENT DOCUMENTS

| | | | |
|---|---|---|---|
| CN | 202602975 | U | 12/2012 |
| JP | H02227993 | A | 9/1990 |
| JP | 2011071772 | A | 4/2011 |
| JP | 2011222122 | A | 11/2011 |
| TW | 201301953 | A | 1/2013 |

* cited by examiner

*Primary Examiner* — David H Vu
(74) *Attorney, Agent, or Firm* — Alan D. Kamrath; Kamrath IP Lawfirm, P.A.

(57) ABSTRACT

A method for controlling a plurality of lamps is applied to an electrical apparatus, such that the user can control the plurality of lamps by the electrical apparatus. The method includes the following steps: receiving a plurality of different identification codes, with the identification codes representing each of the lamps respectively; setting at least two different identification codes of the plurality of identification codes to be in the same control group according to a group setting command; and setting the control parameter of each of the plurality of lamps represented by each of the plurality of different identification codes of the same control group to be the same.

14 Claims, 10 Drawing Sheets

141a

| Group | Identification Code |
|---|---|
| Group 1 | 002、003 |
| Group 2 | 001、004 |
| ⋮ | .. .. |

FIG. 9

141b

| Identification Code | Control Parameter |
|---|---|
| 001 | .. .. |
| 002 | .. .. |
| ⋮ | .. .. |

FIG. 10

METHOD FOR CONTROLLING LAMPS AND COMPUTER PROGRAM PRODUCT THEREOF

BACKGROUND OF THE INVENTION

1. Field of the Invention

The present invention relates to a method for controlling a plurality of lamps and a computer program product thereof. More particularly, the present invention relates to a method and a computer program product thereof which can set a group to control the plurality of lamps at the same time.

2. Description of the Related Art

Portable electrical apparatus (such as a cellphone or a tablet computer) is becoming an indispensable piece of standard equipment for modem life and work. In particular, the smartphone is almost considered a necessity by the majority of people. Since the smartphone, unlike the traditional cellphone, which has only the communication function, is also a small portable computer with great computing and a processing power, and since the smartphone is small and light, it has gradually taken on some former functions of the notebook computer.

Currently, most lighting control of lamps is controlled by hardware. Even a remote controller for distance control of lighting of lamps, the size of the remote controller is limited, and cost is a consideration. In addition, the controlling functions of the remote controller is very limited. As smartphones become increasingly common, and if the operation and control of lamps can be controlled by smartphones, the production cost of the remote controller can be reduced, and via software applications, there can be various controlling methods of the lamp light.

SUMMARY OF THE INVENTION

It is an object of the present invention to provide a method and a computer program product for controlling a plurality of lamps. The method and the computer program product can set a group of a plurality of lamps to control the plurality of lamps to light.

To achieve the abovementioned object, the method of the present invention is applied to an electrical apparatus, such that the user can control the plurality of lamps by the electrical apparatus. The method includes the following steps: receiving a plurality of different identification codes, with the identification codes representing each of the lamps, respectively; setting at least two identification codes of the plurality of identification codes to be in the same control group according to a group setting command; and setting a control parameter of each of the lamps represented by each of the identification codes of the same control group to be the same.

The computer program product of the present invention can be executed by a computer after the computer program product is loaded. When the computer loads and executes the computer program product, the computer can complete the abovementioned method of controlling the lamps.

BRIEF DESCRIPTION OF THE DRAWINGS

The exemplary embodiment(s) of the present invention will be understood more fully from the detailed description given below and from the accompanying drawings of various embodiments of the invention, which, however, should not be taken to limit the invention to the specific embodiments, but are for explanation and understanding only.

FIG. 9 illustrates a schematic drawing of the database of the group of the lamp.

FIG. 10 illustrates a schematic drawing of the database with the lamp control parameter.

DETAILED DESCRIPTION OF THE PREFERRED EMBODIMENTS

Figure 1:
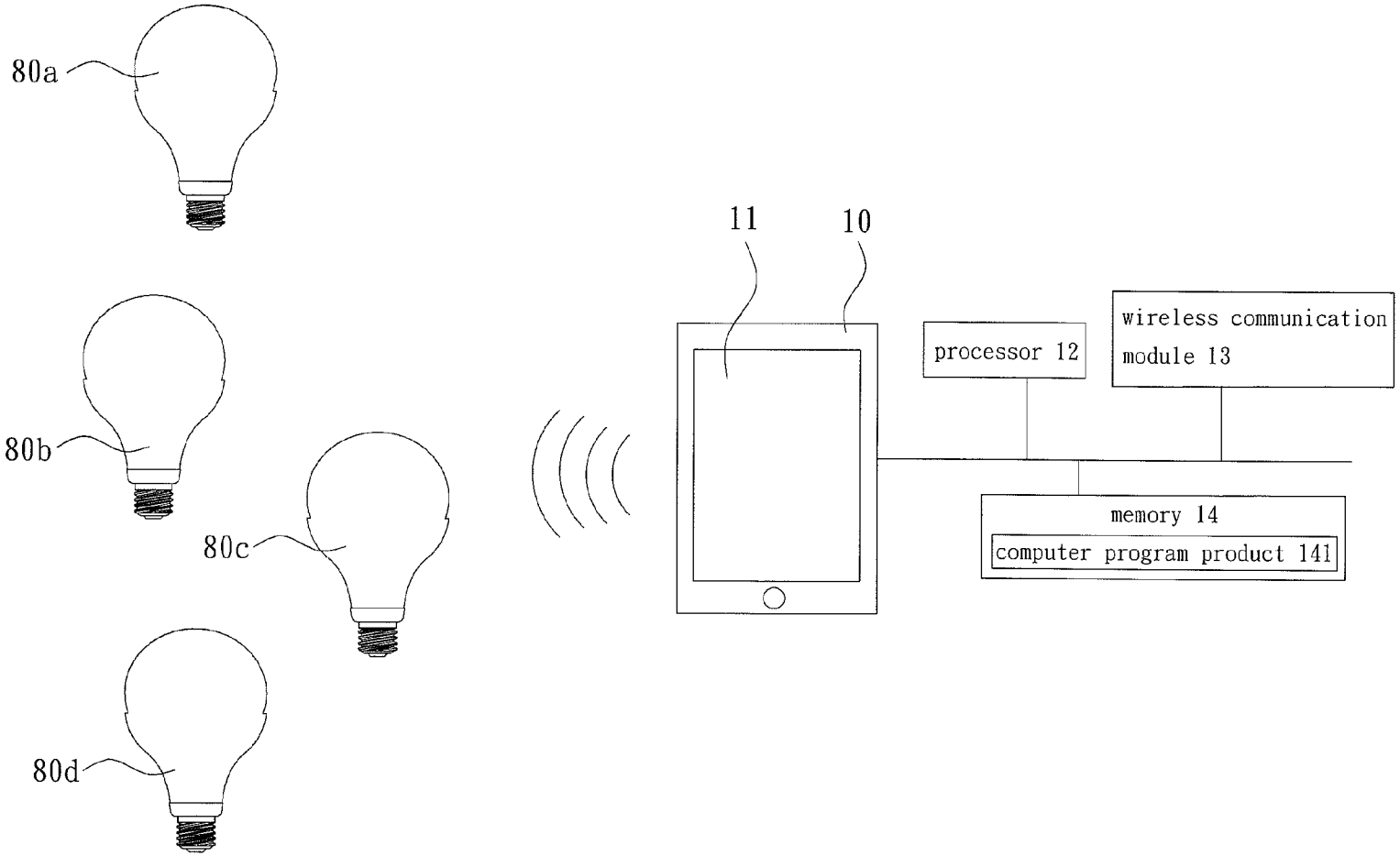
FIG. 1 illustrates a schematic drawing of the environment during use of the computer program product.

Please refer to FIG. 1, which illustrates a schematic drawing of the environment during use of the computer program product.

In one embodiment of the present invention, the method for controlling a plurality of lamps of the present invention is applied to an electrical apparatus 10. As shown in FIG. 1, the electrical apparatus 10 includes a monitor 11, a processor 12, a wireless communication module 13, and a memory 14. The memory 14 stores the computer program product 141 of the present invention. When the processor 12 of the electrical apparatus 10 loads and executes the computer program product 141, the electrical apparatus 10 can execute the method for controlling the lamps of the present invention, allowing the user to control the plurality of lamps 80*a*, 80*b*, 80*c*, 80*d* to light via operating the electrical apparatus 10. Each of the lamps 80*a*, 80*b*, 80*c*, 80*d* includes the same wireless communication module (not shown in the figure) as the electrical apparatus 10. Each of the lamps 80*a*, 80*b*, 80*c*, 80*d* includes an identification code, and every identification code is different for respectively representing each of the lamps 80*a*, 80*b*, 80*c*, 80*d*. In one specific embodiment of the present invention, the electrical apparatus 10 is a smartphone, and the wireless communication modules 13 of the electrical apparatus 10 and the lamps 80*a*, 80*b*, 80*c*, 80*d* are Bluetooth communication devices, but the present invention is not limited to that design.

Figure 2:
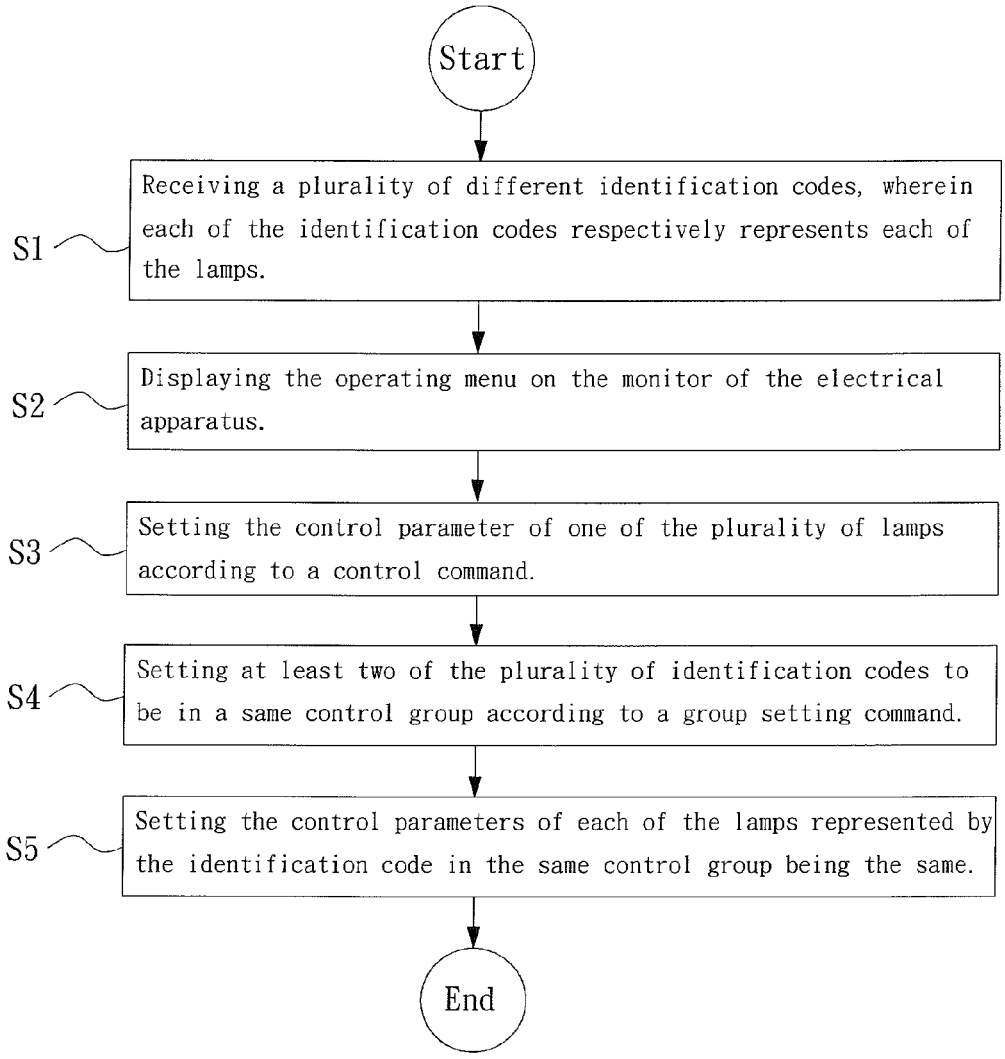
FIG. 2 illustrates a step flowchart of the method for controlling the lamp of the present invention.

Please refer to FIG. 1 to FIG. 8. FIG. 2 illustrates a step flowchart of the method for controlling the lamp of the present invention. Please refer to FIG. 1 and FIG. 3 to FIG. 8, to describe each step shown in FIG. 2 in turn. It is to be understood that the following description uses the abovementioned electrical apparatus 10 as an example to describe the method for controlling the lamp of the present invention. However, the present method is not limited to being applied to the abovementioned electrical apparatus 10.

As shown in FIG. 2, first is executing step S1: receiving a plurality of different identification codes, with each of the identification codes respectively representing each of the lamps.

As shown in FIG. 1, in one embodiment of the present invention, when the electrical apparatus 10 loads the computer program product 141 of the present invention, the electrical apparatus 10 displays a program icon (not shown in the figure) on the monitor 11. The user may click the program icon to control the processor 12 to load and execute the computer program product 141, allowing the user to control the lamps 80*a*, 80*b*, 80*c*, 80*d* to light via the operating of the electrical apparatus 10. After the processor 12 executes the computer program product 141, first of all, the processor 12 controls the wireless communication module 13 to receive the identification codes sent by the lamps 80*a*, 80*b*, 80*c*, 80*d* within a certain range, and temporarily stores the identification codes in the memory 14. Since using the Bluetooth communication device to transfer the signal is well known in the prior art, there is no need for further description.

Second is executing step S2: displaying the operating menu on the monitor of the electrical apparatus.

Figure 3:
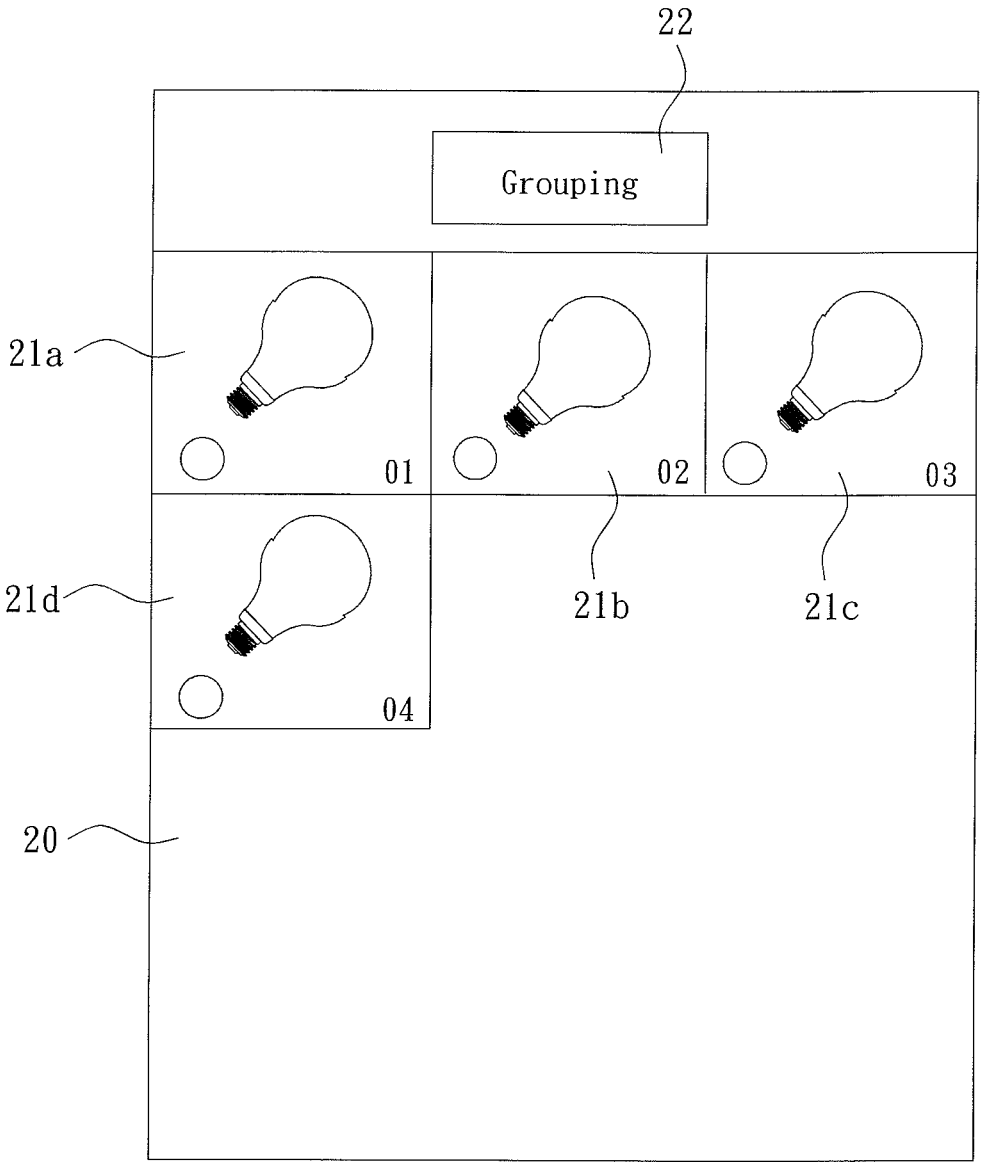
FIG. 3 illustrates a schematic drawing of the first operating menu when the lamp does not light.
Figure 4:
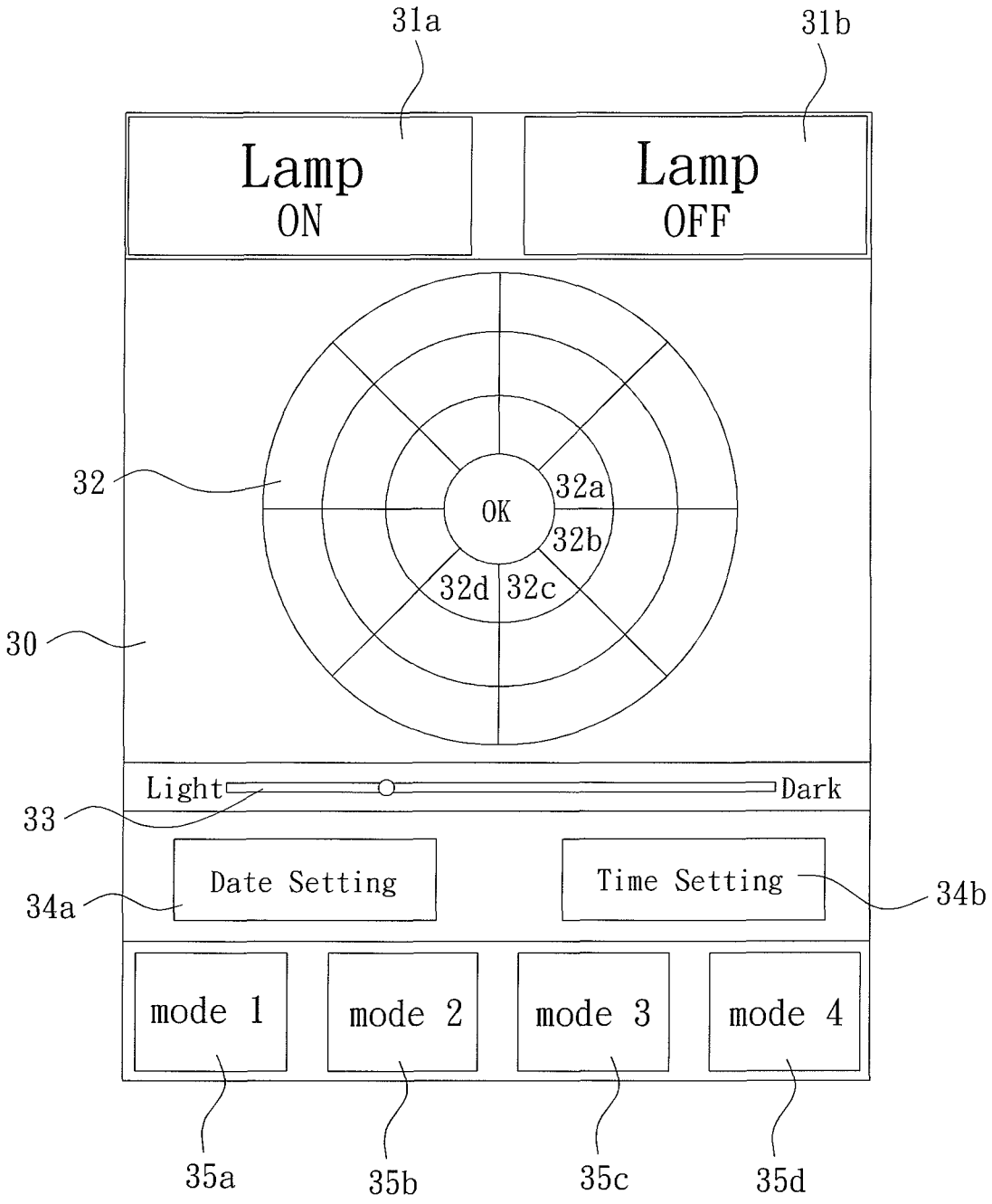
FIG. 4 illustrates a schematic drawing of the second operating menu.

As shown in FIG. 3, in one embodiment of the present invention, after the electrical apparatus 10 receives the identification code, the electrical apparatus 10 displays a first operating menu 20 as shown in FIG. 3 on the monitor 11 of the electrical apparatus 10, allowing the user to select and operate. The first operating menu 20 includes a plurality of lamp icons 21*a*, 21*b*, 21*c*, 21*d*, which correspond to each of the identification codes and the grouping or group part 22. Each of the lamp icons 21*a*, 21*b*, 21*c*, 21*d* respectively represents each of the lamps 80*a*, 80*b*, 80*c*, 80*d*. After the user selects one of the lamp icons, the electrical apparatus 10 displays a second operating menu 30 as shown in FIG. 4 on the monitor 11. The second operating menu 30 includes a turning on part 31*a*, a turning off part 31*b*, a color setting part 32, a brightness setting part 33, a date setting part 34*a*, a time setting part 34*b*, and a plurality of mode setting parts 35*a*, 35*b*, 35*c*, 35*d*. The color setting part 32 includes many color options 32*a*, 32*b*, 32*c*, 32*d* of different colors (the color options 32*a*, 32*b*, 32*c*, 32*d* are represented as four labels in FIG. 4; for example, color option 32*a* represents blue, and color option 32*b* represents yellow). Turning on part 31*a* is used for allowing the user to enter the command to control and turn on the lamps 80*a*, 80*b*, 80*c*, 80*d*. Turning off part 31*b* is used for allowing the user to enter the command to control and turn off the lamps 80*a*, 80*b*, 80*c*, 80*d*. The color setting part 32 is used for allowing the user to enter the command to control the light color of the lamps 80*a*, 80*b*, 80*c*, 80*d*. The date setting part 34*a* and the time setting part 34*b* are used for allowing the user to enter the command to control the lighting time of the lamps 80*a*, 80*b*, 80*c*, 80*d*. The brightness setting part 33 is used for allowing the user to enter the command to control the light brightness of the lamps 80*a*, 80*b*, 80*c*, 80*d*. The plurality of mode setting parts 35*a*, 35*b*, 35*c*, 35*d* are used for allowing the user to enter the command to control the lamps 80*a*, 80*b*, 80*c*, 80*d* to light in the default color and brightness at the default time.

Figure 8:
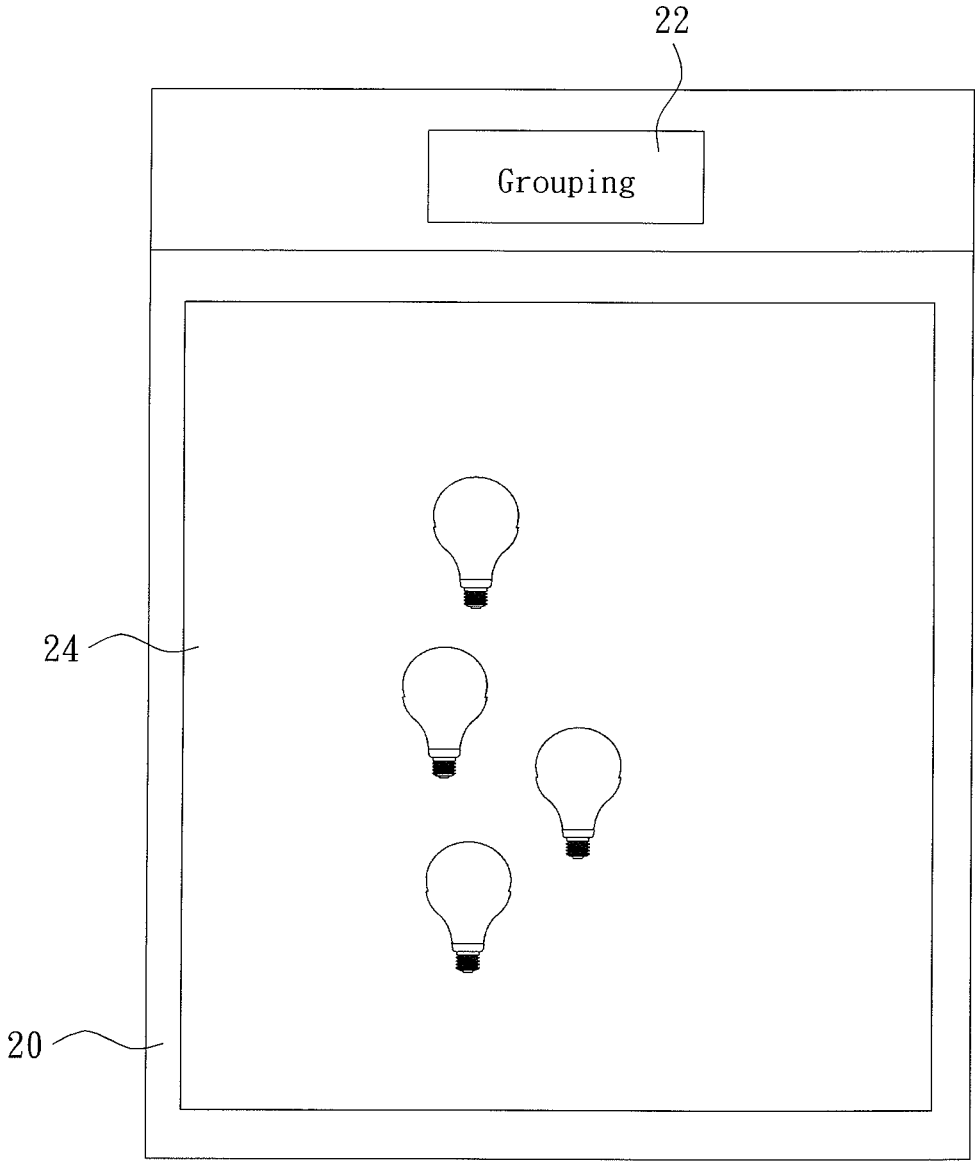
FIG. 8 illustrates a schematic drawing of another environment of the first operating menu.

Furthermore, as shown in FIG. 8, in another embodiment of the present invention, the first operating menu 20 can display a photo or picture 24 of the environment having the plurality of lamps, allowing the user to enter the control command or the group setting command via clicking each of the lamps on the photo or picture 24. The photo or picture 24 can be taken in advance from the environment having the plurality of lamps 80*a*, 80*b*, 80*c*, 80*d* via the electrical apparatus 10 by the user. After taking the photo or picture 24, via the analysis of the photo or picture 24 made by the computer program product 141, the position of each of the lamps 80*a*, 80*b*, 80*c*, 80*d* is shown in the photo or picture 24 and displayed on the monitor 11 of the electrical apparatus 10 (FIG. 8 represents only the relative positions of the lamps and does not represent the background of the environment where the lamp is situated). Then, the user can enter the control command or the group setting command via the photo or picture 24. After the user clicks one bulb in the photo or picture 24, the monitor 11 of the electrical apparatus 10 displays the second operating menu 30 as shown in FIG. 4. The user can also manually select or change the position of each of the lamps 80*a*, 80*b*, 80*c*, 80*d*.

Third is executing step S3: setting the control parameter of one of the plurality of lamps according to a control command.

After the electrical apparatus 10 displays the abovementioned operating menu that includes the first operating menu 20 and the second operating menu 30 on the monitor 11, the user can enter the control command via selecting and operating the operating menu. In one embodiment of the present invention, the entering method for the control command includes:

1. Selecting one lamp icon of the plurality of lamp icons 21*a*, 21*b*, 21*c*, 21*d* in the first operating menu 20. After selection, the electrical apparatus 10 displays the second operating menu 30 on the monitor 11.
2. Entering the control command for setting each of the control parameters in the second operating menu 30. After the parameters are entered, the electrical apparatus 10 sets the control parameters of the lamps 80*a*, 80*b*, 80*c*, 80*d* according to the control parameters set by the control commands.

Figure 5:
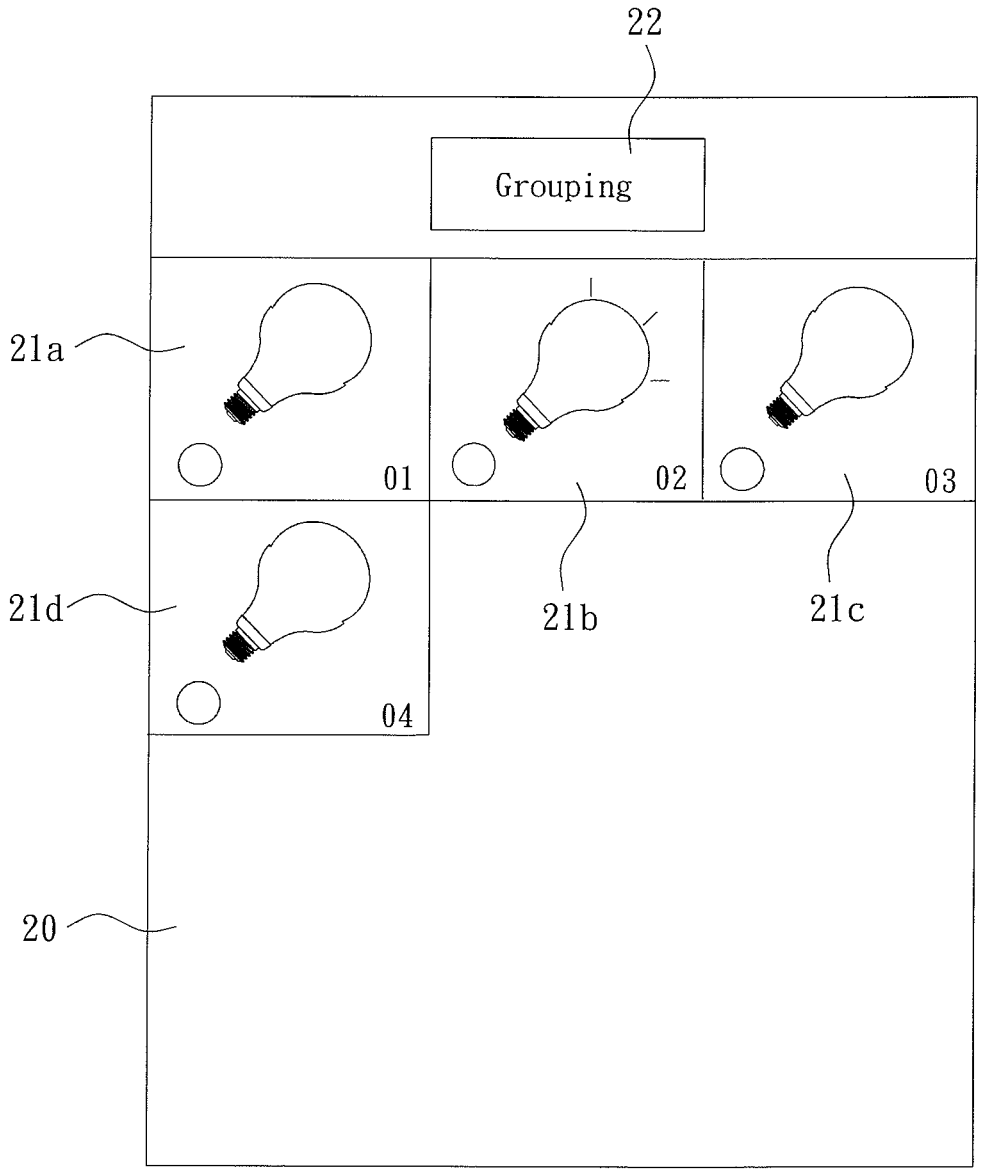
FIG. 5 illustrates a schematic drawing of the first operating menu when the lamp lights.

For example, if the user wants the lamp 80*b* to automatically emit blue lights every night from 17:00 to 23:00, the user only needs to select the lamp icon 21*b* as. NO. 2 (because the lamp icon 21*b* of NO. 2 represents the lamp 80*b*), then select the turning on part 31*a* in the second operating menu 30, select the color option 32*a* representing blue in the color setting part 32, and set the lighting date and time to every night from 17:00 to 23:00 via the date setting part 34*a* and the time setting part 34*b*. Thus, the electrical apparatus 10 can set the control parameter of the lamp 80*b* according to the control commands for setting the control parameter, allowing the lamp 80*b* to light based on the control parameter set by the user. As shown in FIG. 5, after the setting of the lamp 80*b* control parameter is completed, when the lamp 80*b* lights, the lamp icon 21*b*, which represents the lamp 80*b*, also lights to represent that the corresponding lamp 80*b* is lit, and the background color of the lamp icon 21*b* is the same as the light color of the lamp 80*b*.

Furthermore, in another embodiment of the present invention, the abovementioned control command can also be entered via changing the spatial position of the electrical apparatus 10 or turning the electrical apparatus 10 to provide a more convenient operating method, allowing the user to change the control parameter of each of the lamps 80*a*, 80*b*, 80*c*, 80*d*. For example, the user may turn on/off the lamps 80*a*, 80*b*, 80*c*, 80*d* via turning the electrical apparatus 10. The user may move the electrical apparatus 10 in a circle to adjust the light color of the lamps 80*a*, 80*b*, 80*c*, 80*d*. The user may move the electrical apparatus 10 vertically or horizontally to adjust the light brightness of the lamps 80*a*, 80*b*, 80*c*, 80*d*. However, the present invention is not limited to that design.

In addition to manual setting of the control parameters, a plurality of default modes are also provided for the controlling setting in the present invention, and each of the default modes has different control parameters. For example, there may be a mode for the treatment of acne. When the user selects the default mode in the plurality of mode setting parts 35*a*, 35*b*, 35*c*, 35*d* of the second operating menu 30 via the electrical apparatus 10, the electrical apparatus 10 sets the control parameter of the lamps 80*a*, 80*b*, 80*c*, 80*d* as the default control parameter, such that the control parameter can be the control parameter allowing the lamps 80*a*, 80*b*. 80*c*, 80*d* to emit red and blue light for treating acne.

Executing step S4: setting at least two of the plurality of identification codes to be in a same control group according to a group setting command.

Figure 6:
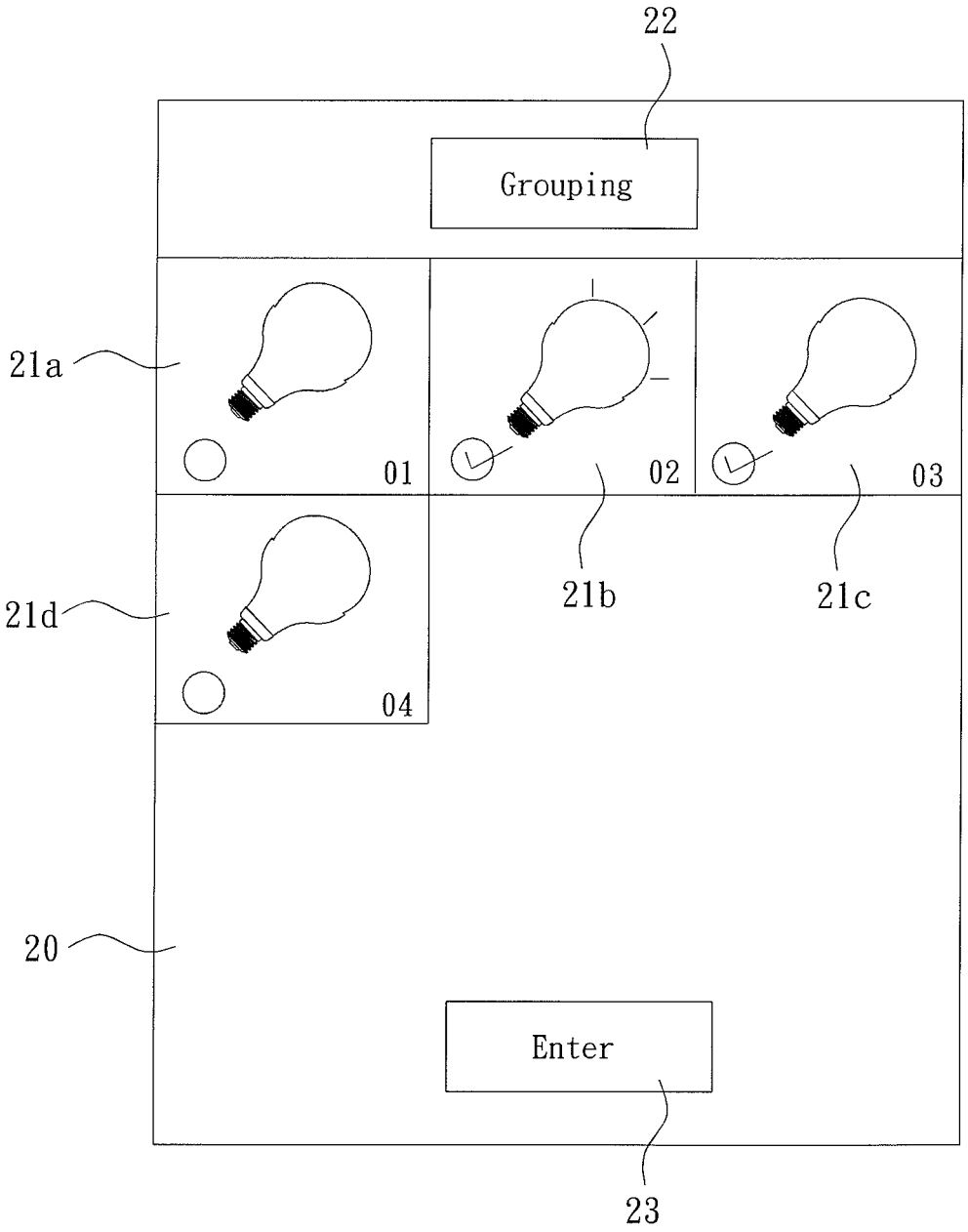
FIG. 6 illustrates an operating schematic drawing of setting the group of the lamp via the first operating menu.
Figure 7:
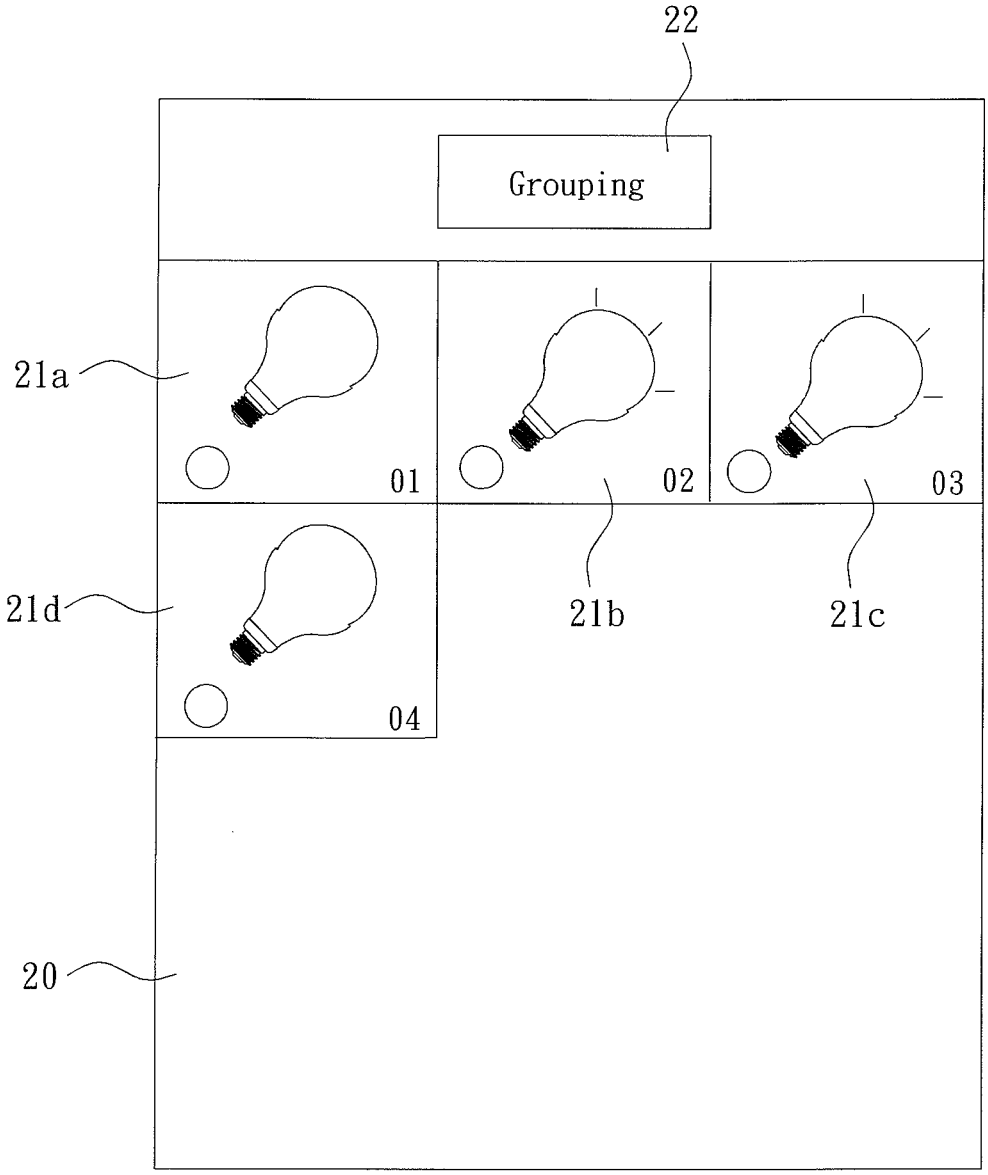
FIG. 7 illustrates a schematic drawing of the first operating menu after the group of the lamp is set.

As shown in FIG. 5, in one embodiment of the present invention, after the control parameter of one lamp 80*b* of the plurality of lamps 80*a*, 80*b*, 80*c*, 80*d* is completely set, allowing the lamp 80*b* to light, the monitor 11 displays a menu as shown in FIG. 5. Then, the user can enter the group setting command in the first operating menu 20. When operating the operating menu, at first, the user needs to select the grouping or group part 22 on the top. After selecting the grouping or group part 22, the electrical apparatus 10 enters a pairing mode. The user can select the paired groups of the lamps 80*a*, 80*b*, 80*c*, 80*d*, such as the NO. 2 lamp icon 21*b* and the NO. 3 lamp icon 21*c*. After selection of the paired groups, the menu shown in FIG. 6 is displayed. Finally, after the user selects the confirmation part 23, the two identification codes corresponding to the NO. 2 lamp icon 21*b* and the NO. 3 lamp icon 21*c* will be set to the same control group, which means each of the lamps 80*b*, 80*c* represented by the two identification codes will be set to the same control group.

Lastly is executing step S5: setting the control parameters of each of the lamps represented by the identification code in the same control group being the same.

In one embodiment of the present invention, after step S4 is completed, the electrical apparatus 10 allows the control parameters of each of the lamps 80*b*, 80*c* represented by the identification codes in the same group to be the same, and the control parameter is set to be the same as the control parameter of the lamp 80*b*. The control parameter is the last setting before execution of the group setting. Taking this embodiment as an example, and before executing the group setting, the lamp which is the last one to be set is the lamp 80*b*, represented by NO. 2. Therefore, after the lamp 80*b* represented by NO. 2 and the lamp 80*c* represented by NO. 3 are set to be in the same group, the control parameter of the lamp 80*c* represented by NO. 3 and the control parameter of the lamp 80*b* represented by NO. 2 will be set to be the same. It is to be understood that setting the plurality of lamps to be in the same group and setting the control parameter of the same group to be the same requires only a simple database. As shown in FIG. 8, which illustrates a lamp group database 141*a*, after the abovementioned group action set is completed, for example, the computer program product 141 establishes the group 1 and records the identification code represented by NO. 2 and the identification code represented by NO. 3 in the group 1. As shown in FIG. 9, which illustrates a lamp control parameter database 141*b*, the lamp control parameter database 141*b* records the control parameter corresponding to each of the lamps (identification code). When the user sets one of the control parameters of the lamps represented by the identification code, the control parameters of the lamps represented by the identification code in the same group change at the same time.

It is to be understood that the method for controlling the lamp of the present invention is not limited to the sequence of the abovementioned steps, since the sequence of the abovementioned steps can be changed such that the object of the present invention can still be achieved. For example, after the setting group action is executed, the control parameter of one of the lamps in the same group can be set. After the setting is completed, the control parameters of other lamps in the group will be set to be the same as the control parameter of the lamp.

Via the abovementioned description, the method for controlling the lamps of the present invention allows the user to control the lamps to light via operating a portable electrical apparatus such as a cellphone or tablet computer, and provides the function of group setting, allowing the user remote control of the plurality of lamps to light via the setting of the lamp. In addition, by selecting the setting of the build-in default mode, the user can quickly and correctly control the lamps to emit light with a specific function (such as light for the treatment of acne or for helping tubers to grow faster), such that the convenience of controlling of the lamp is optimized.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A method for controlling a plurality of lamps, applied to an electrical apparatus, allowing a user to control the plurality of lamps via the electrical apparatus, the method comprising:

receiving a plurality of different identification codes, wherein the plurality of different identification codes respectively represent each of the plurality of lamps;

setting at least two of the plurality of different identification codes to be in a same control group according to a group setting command; and setting a control parameter of each of the plurality of lamps represented by each of the plurality of different identification codes in the same control group to be the same.

2. The method as claimed in claim 1, wherein before receiving the group setting command, the method further comprises:

setting the control parameter of one of at least two of the plurality of lamps according to a control command;

wherein after the at least two of the plurality of different identification codes are set to be in the same control group, the control parameters of respective lamps of other identification codes are set to be the same as the control parameter of the lamp, wherein the other identification codes and the identification code are in the same control group.

3. The method as claimed in claim 2, further comprising:

displaying at least one operating menu on a monitor of the electrical apparatus, allowing the user to enter the control command or the group setting command via operating the at least one operating menu.

4. The method as claimed in claim 3, wherein the at least one operating menu comprises a photo or picture of an environment having the plurality of lamps, allowing the user to enter the control command or the group setting command via clicking each of the plurality of lamps in the photo or picture.

5. The method as claimed in claim 2, further providing a plurality of default modes, with each of the default modes having different control parameters; and wherein when the user selects one default mode of the plurality of default modes via the control command, the at least two of the plurality of lamps light according to the control parameter of the default mode.

6. The method as claimed in claim 1, wherein the control parameter is used for determining a lighting color, a lighting brightness, a start-up time, an off time, or a lighting time of the plurality of lamps.

7. The method as claimed in claim 2, wherein the control parameter is used for determining a lighting color, a lighting brightness, a start-up time, an off time, or a lighting time of the plurality of lamps.

8. The method as claimed in claim 3, wherein the control parameter is used for determining a lighting color, a lighting brightness, a start-up time, an off time, or a lighting time of the plurality of lamps.

9. The method as claimed in claim 4, wherein the control parameter is used for determining a lighting color, a lighting brightness, a start-up time, an off time, or a lighting time of the plurality of lamps.

10. The method as claimed in claim 5, wherein the control parameter is used for determining a lighting color, a lighting brightness, a start-up time, an off time, or a lighting time of the plurality of lamps.

11. The method as claimed in claim 2, wherein the control command can be entered via changing a spatial position or turning the electrical apparatus.

12. The method as claimed in claim 3, wherein the control command can be entered via changing a spatial position or turning the electrical apparatus.

13. The method as claimed in claim 4, wherein the control command can be entered via changing a spatial position or turning the electrical apparatus.

14. The method as claimed in claim 5, wherein the control command can be entered via changing a spatial position or turning the electrical apparatus.

* * * * *